US006499416B2

(12) United States Patent
Stewart et al.

(10) Patent No.: US 6,499,416 B2
(45) Date of Patent: Dec. 31, 2002

(54) METHOD AND APPARATUS FOR MANUFACTURING A VALANCE

(75) Inventors: Parks C. Stewart, Lawrenceville, GA (US); Robert A. Trobaugh, III, Avondale Estates, GA (US)

(73) Assignee: Phoenix Automation, Inc., Norcross, GA (US)

( * ) Notice: Subject to any disclaimer, the term of this patent is extended or adjusted under 35 U.S.C. 154(b) by 0 days.

(21) Appl. No.: 09/751,651

(22) Filed: Dec. 29, 2000

(65) Prior Publication Data

US 2002/0083875 A1 Jul. 4, 2002

(51) Int. Cl.[7] ..... D05B 35/02; D05B 19/00

(52) U.S. Cl. ..... 112/475.06; 112/470.05; 112/470.16

(58) Field of Search ..... 112/470.16, 470.01, 112/470.05, 470.36, 470.33, 147, 141, 143, 475.06

(56) References Cited

U.S. PATENT DOCUMENTS 5,572,940 A * 11/1996 Burton et al. ..... 112/470.16
5,619,942 A 4/1997 Stewart et al. ..... 112/470.07
5,669,320 A 9/1997 Stewart et al. ..... 112/470.07
5,685,248 A 11/1997 Stewart et al. ..... 112/470.07
5,928,462 A 7/1999 Stewart et al. ..... 156/359
6,058,863 A 5/2000 Stewart et al. ..... 112/470.36
6,082,281 A 7/2000 Root et al. ..... 112/475.03
6,136,120 A 10/2000 Stewart et al. ..... 156/88
6,189,470 B1 2/2001 Root et al. ..... 112/470.13
6,209,469 B1 * 4/2001 Burton et al. ..... 112/475.06

* cited by examiner

*Primary Examiner*—Peter Nerbun
(74) *Attorney, Agent, or Firm*—Sutherland Asbill & Brennan LLP

(57) ABSTRACT

An apparatus for manufacturing a valance with a number of transverse pockets from a continuous strip of material. The apparatus may include a feed pull assembly positioned along a predetermined path for pulling a predetermined length of the continuous strip of material onto a tabletop, a cutter assembly for cutting the predetermined length of the material from the strip, a first fold assembly to fold a first end of the length of the material, a second fold assembly to fold a second end of the length of the material under the first end, and a hemming assembly to sew the transverse pockets.

39 Claims, 8 Drawing Sheets

METHOD AND APPARATUS FOR MANUFACTURING A VALANCE

TECHNICAL FIELD

The present invention generally relates to a finishing apparatus for a textile product and more particularly relates to an apparatus that automatically hems, folds, and sews a piece of material into a high quality valance.

BACKGROUND OF THE INVENTION

Generally described, a valance is an ornamental window treatment. A valance typically extends across the top portion of a window frame and window. The design of a typical valance is shown in FIGS. 1–3. As is shown, a valance 10 may be made from a single piece of a textile material 20. The piece of material 20 may include a cotton fabric, a blend of cotton and synthetic fabrics, or other types of traditional textile materials.

The piece of material 20 may have a first end 21, a second end 22, a first side 23, and a second side 24. The sides 23, 24 of the piece of material 20 may be folded over and sewn to create a first side hem 30 and a second side hem 35. The piece of material 20 may then be folded with the first end 21 folded over the second end 22 so as to create a front side 46 and a backside 47. The piece of material 20 may then be hemmed transversely so as to create the valance 10 with a top pocket 50, a hanger pocket 55, and a bottom pocket 60. A first hem line 65 and a second hem line 70 may be used to create the pockets 50, 55, 60. The valance 10 may then be hung adjacent to a window from a frame or a hanger of some sort that extends through the hanger pocket 55. The bottom pocket 60 may be filled with paper or other types of materials so as to create a textured appearance.

Traditionally, the valance 10 is generally manufactured by hand. The manufacturing process, however, may be time consuming and expensive. A high quality valance 10 generally requires that the sides 23, 24 and the pockets 50, 55, 60 be even and aligned so as to provide a uniform appearance. Consistently centering the sides 23, 24, however, has proven to be difficult. The production volume for an acceptable valance in the manual or the known manufacturing processes, therefore, has been relatively low.

What is needed, therefore, is a method and an apparatus for manufacturing a valance in an automated, consistent process. The method and apparatus should accurately create a high quality valance in a high-speed manner while being reasonable in terms of costs and manpower.

SUMMARY OF THE INVENTION

The present invention thus provides an apparatus for manufacturing a valance with a number of transverse pockets from a continuous strip of material. The apparatus may include a feed pull assembly positioned along a predetermined path for pulling a predetermined length of the continuous strip of material onto a tabletop, a cutter assembly for cutting the predetermined length of the material from the strip, a first fold assembly to fold a first end of the length of the material, a second fold assembly to fold a second end of the length of the material under the first end, and a hemming assembly to sew the transverse pockets. Specific embodiments of the present invention may include the use of a programmable logic controller to control the feed pull assembly, the cutter assembly, the first fold assembly, the second fold assembly, and the hemming assembly.

The apparatus also may include an unwind assembly positioned along the predetermined path. The unwind assembly may include a number of rollers so as to support the continuous strip of material on a roll. The unwind assembly also may include a dancer assembly to pull the predetermined length of the strip of material off of the roll. The dancer assembly may include a stationary roller and a dancer roller such that the dancer roller pulls the material over the stationary roller.

The cutter assembly may include a blade operated by a hydraulic cylinder. The feed pull assembly may include a feed pull gripper operated by a motor. The hemming assembly may include a first sewing head and a second sewing head positioned on a tabletop.

The apparatus may further include a side hem apparatus positioned adjacent to the feed pull assembly along the predetermined path. The side hem apparatus may include a tabletop with a dimension of lesser amount than a dimension of the predetermined length of the material. A first side and a second side of the material may fall over the tabletop. The side hem apparatus may include an advancement device so as to advance the material along the tabletop. The advancement device may include an advancement belt driven by a motor. The advancement device also may include a first advancement device positioned on a first side of the tabletop and a second advancement device positioned on a second side of the tabletop.

The side hem apparatus may include a fold apparatus so as to fold the first side and the second side of the material. The side fold apparatus may include a pulley system so as to fold the first side and the second side of the material under the tabletop. The side fold apparatus may include a first side fold apparatus positioned on the first side of the tabletop to fold the first side of the material and a second side fold apparatus positioned on the second side of the tabletop to fold the second side. The side hem apparatus may include a first side hemming device and a second side hemming device so as to hem the material along both sides.

The apparatus may further include a transfer assembly positioned along the predetermined path so as maneuver the material in a perpendicular fashion. The transfer assembly may include an in-take roller assembly extending in a first direction and an out-take roller assembly extending in a second direction. The roller assemblies may each have a drive belt driven by a motor and also a lift bar so as to provide motion in the vertical direction. When the in-take roller assembly is engaged on the material, the out-take roller assembly is raised. When the out-take roller assembly is engaged on the material, the in-take roller assembly is raised.

The first fold assembly may include a tabletop. The tabletop may have a dimension of lesser amount than a dimension of the material such that a first end of the material falls over the tabletop. The first fold assembly may include a first side advancement system and a second side advancement system positioned along the tabletop. The advancement systems each may include a drive belt and a motor such that the motor drives the drive belt and the material at a predetermined speed. The motor may include a servo-motor. The tabletop may include a first side fold plate. The first fold assembly also may include a fold system position adjacent to the first side fold plate. The fold system folds the first end of the material under the fold plate until a first fold is formed. The fold system may include a number of drive belts driven by a motor. The first fold plate may end along the predetermined path about where the second side advancement system begins, such that the first end of the material may be advanced between the first side advancement system and the second side advancement system.

The first fold assembly may include a first sensor positioned over the tabletop, a second sensor positioned under the tabletop, and a control system operative with the first sensor, the second sensor, and the motor of the second side drive system. The first sensor and the second sensor may detect if the first fold is even along the predetermined path such that the control system may alter the speed of the motor by a predetermined amount.

The second fold assembly may include a tabletop. The tabletop may have a dimension of lesser amount than a dimension of the material such that a second end of the material falls over the tabletop. The second fold assembly may include a first side advancement system and a second side advancement system positioned along the tabletop. The first side and the second side advancement systems may each have a drive belt and a motor such that the motor drives the drive belt and the material at a predetermined speed. The motor may include a servo-motor. The second fold assembly may include a tucker assembly positioned along the tabletop so as to fold the second end of the material. The tucker assembly may include a belt to carry the lower side of the material along the underside of the plate and hold the material while a final small amount of the material is tucked into the fold to form a hem.

The second fold assembly may include a first sensor positioned over the tabletop, a second sensor positioned under the tabletop, and a control system operative with the first sensor, the second sensor, and the motor of the second fold drive system. The first sensor and the second sensor may detect if the second fold is even along the predetermined path such that the control system may alter the speed of the motor by a predetermined amount.

A method of the present invention provides for creating a valance from a continuous strip of material in a high-speed manner. The method includes the steps of pulling a predetermined length of material onto a tabletop, cutting the length of material from the continuous strip, advancing the material along the tabletop, folding a first end of the material against itself, folding a second end of the material against the first end, and hemming the material transversely to form a number of pockets therein.

A further embodiment of the present invention provides for an advancement device for a folded textile product. The textile product may have a first section and a second section. The device may include a tabletop with a first side and a second side. A first side advancement system may be positioned along the first side of the tabletop and a second side advancement system may be positioned along the second side of the tabletop. The advancement systems each may include an advancement belt driven by a motor. The textile product may be wrapped about the tabletop with the first section extending along the first side of the tabletop and driven by the advancement belt of the first side advancement system and the second section extending along the second side of the tabletop and driven by the advancement belt of the second side advancement system. A first sensor may be positioned about the first side of the tabletop and a second sensor may be positioned about the second side of the tabletop. The sensors may determine if the first section of the textile product is advancing evenly with the second section.

The motor of the second side advancement system may include a servo-motor. The servo-motor may have a predetermined speed. The predetermined speed of the servo-motor may be altered by a predetermined amount depending upon position of the second side of the textile product with respect to the first side as determined by the sensors. The predetermine amount may include a predetermined number of counts of the servo-motor. The second side advancement system may include a number of skis positioned about the advancement belt. A control system may control the motor of the first or the second side advancement system with respect to the sensors.

A further method of the present invention provides for advancing a piece of material in a high speed manner. The method includes the steps of pulling the material onto a fold plate having a top side and a bottom side, folding the material about the top side and the bottom side of the fold plate so as to form a first side and a second side, advancing the material along the top side and the bottom side of the fold plate at a predetermined speed, monitoring the advancement of the first side and the second side of the material along the tabletop, and altering the predetermined speed if the first side or the second side of the material are not in alignment.

A further embodiment of the present invention provides for a folding device for forming a fold in a sheet of a textile material. The device includes a tabletop having a lesser dimension than a dimension of the sheet such that an end of the sheet hangs over the tabletop. A first side advancement system may be positioned on the top of the tabletop to advance the sheet thereon. A fold assembly may be positioned adjacent to the tabletop to fold the end of the sheet under the tabletop. A second side advancement system may be positioned on the bottom of the tabletop to hold the end of the sheet under the tabletop. The tabletop may have an aperture therein so as to allow the end of the sheet to rise on top of the tabletop and to form the fold.

The advancement systems each may have a drive belt and a servo-motor. The servo-motor may drive the drive belt and the sheet at a predetermined speed. The fold assembly may include a number of drive belts driven by a motor such that each of the drive belts folds the end of the sheet until the end is held underneath the tabletop. The device also may have a first sensor positioned over the tabletop, a second sensor positioned under the tabletop, and a control system operative with the first sensor, the second sensor, and the motor of the second side advancement system. The sensors may detect if the sheet is even along the top and the bottom of the tabletop. The control system may alter the predetermined speed of the servo-motor by a predetermined amount if the sheet is not even.

Other objects, features, and advantages of the present invention will be come apparent upon review of the following specification, when taken in conjunction with the drawings and the appended claims.

BRIEF DESCRIPTION OF THE DRAWINGS

FIG. 10 is a side plan view of the feed transfer assembly used in the manufacturing apparatus of FIG. 5.

DETAILED DESCRIPTION OF THE INVENTION

Figure 1:
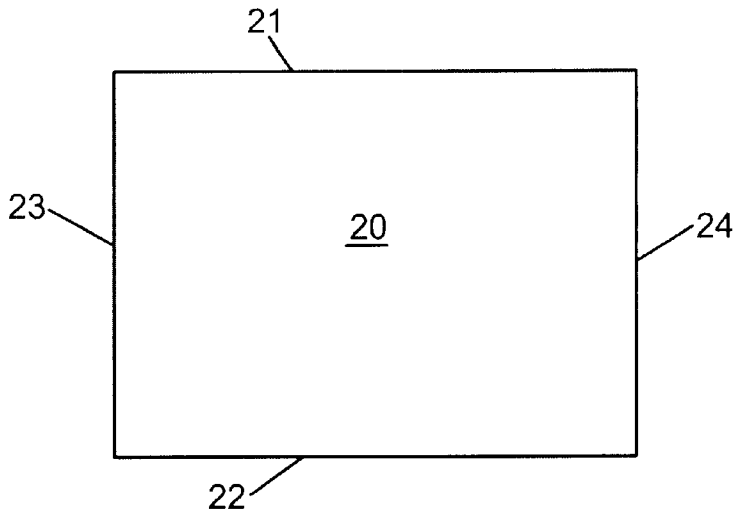
FIG. 1 is a plan view of a piece of material for use with the present invention.
Figure 2:
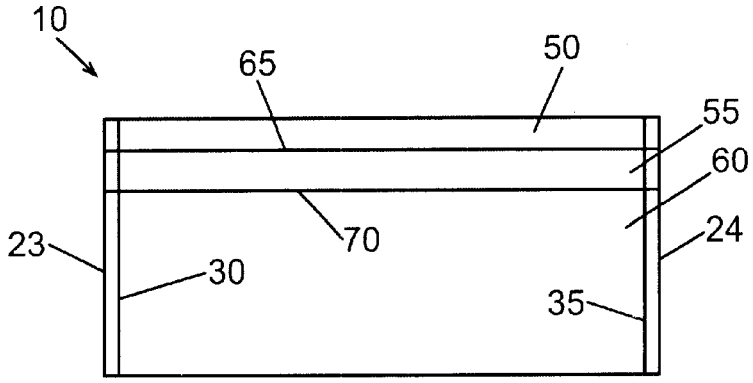
FIG. 2 is a plan view of a valance manufactured according to the present invention.
Figure 3:
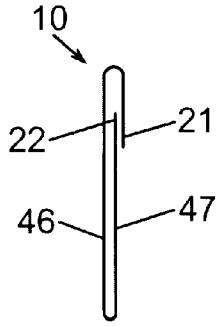
FIG. 3 is an exaggerated side view of the valance of FIG. 2.

Referring now to the drawings, in which like numerals represent like parts throughout the several views, FIGS. 5–13 show a valance manufacturing apparatus 100 of the present invention. The valance apparatus 100 may cut, hem, fold, and sew the valance 10 from the single sheet of material 20 in a high-speed and efficient manner. The valance apparatus 100 may operate in an assembly line-type fashion along a predetermined path P through the various stations described below to form the valance 10.

Operation of the valance manufacturing apparatus 100 and each of the individual components herein may be controlled by a control system 105. The control system 105 may include a Programmable Logic Controller ("PLC") such as the Series 90–30 PLC sold by the General Electric Company of Fairfield, Conn. Alternatively, a personal computer, such as a conventional IBM-compatible computer with the Pentium® microprocessor sold by Intel Corporation of Santa Clara, Calif., or an equivalent processor, may be used. Other types of conventional control devices also may be employed. More than one control system 105 may be used.

Figure 4:
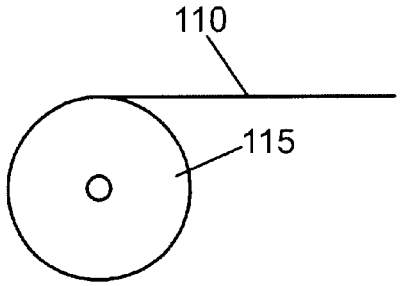
FIG. 4 is a side view of a roll with a continuous sheet of material positioned thereon.
Figure 5:
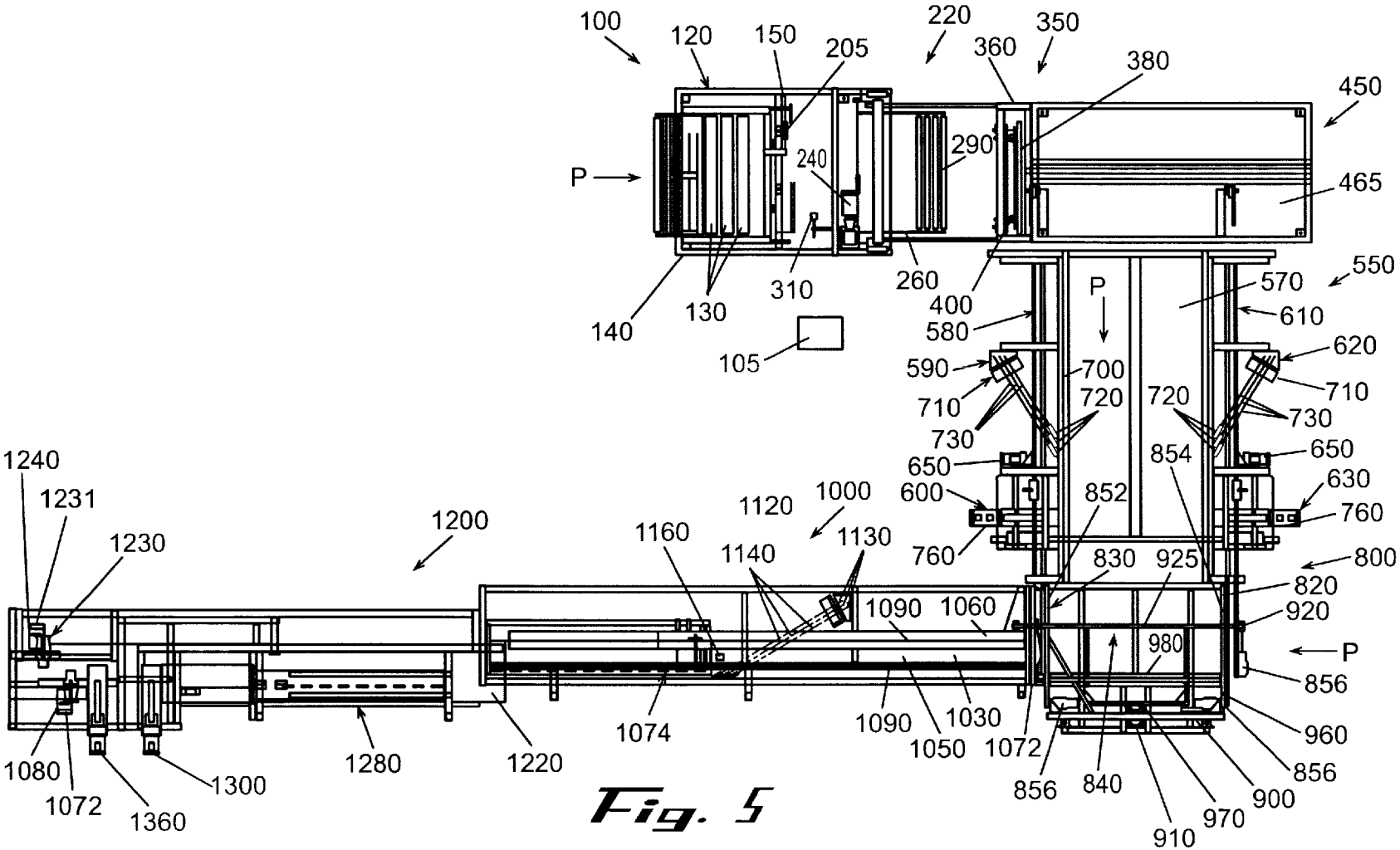
FIG. 5 is a top plan view of the valance manufacturing apparatus of the present invention.
Figure 6:
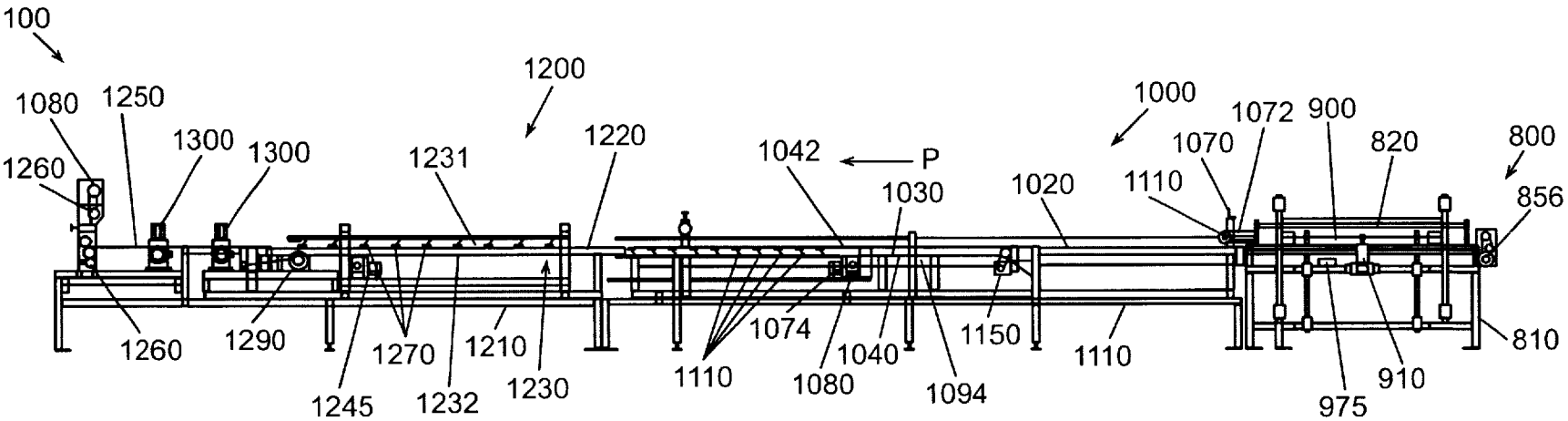
FIG. 6 is a side plan view of the valance manufacturing apparatus of FIG. 5.
Figure 7:
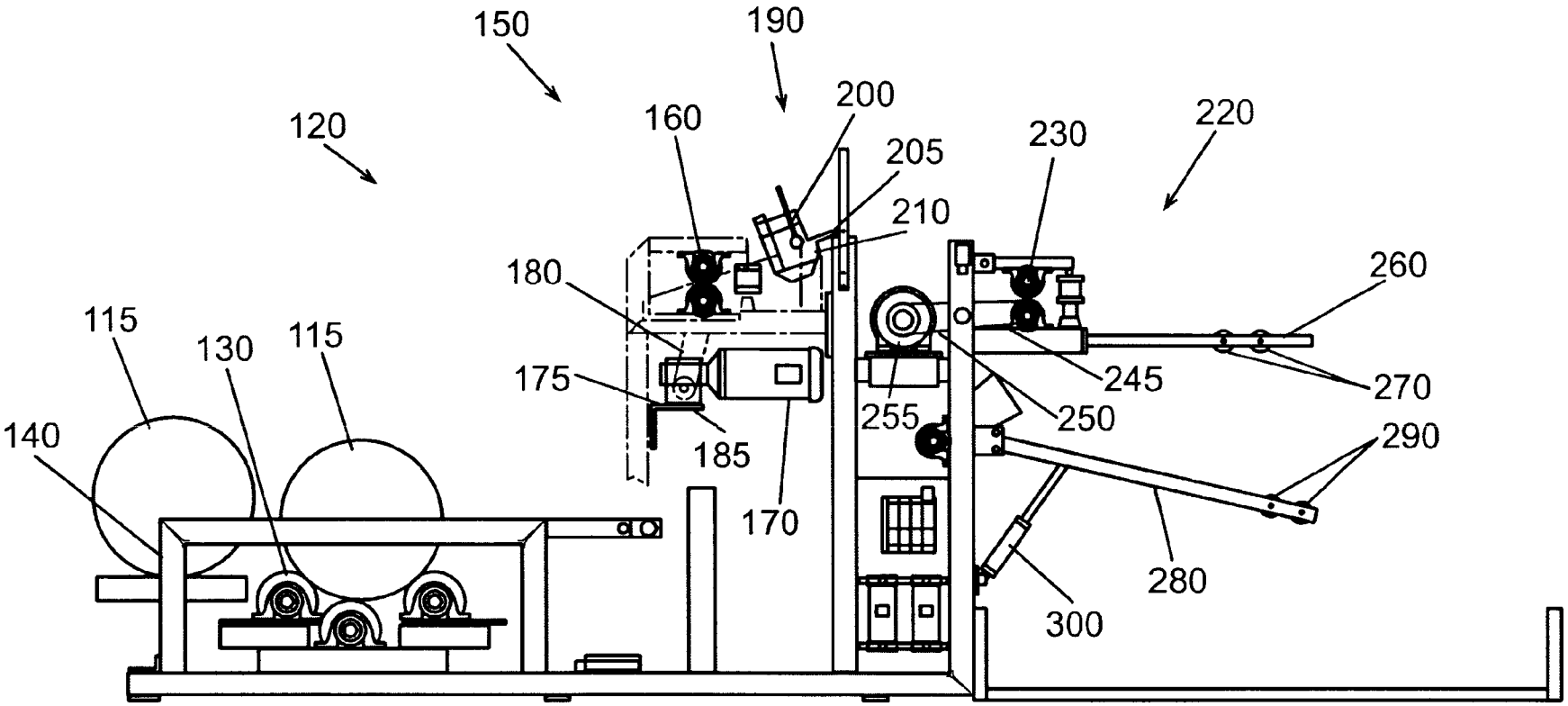
FIG. 7 is a side plan view of the unwind assembly used in the manufacturing apparatus of FIG. 5.
Figure 8:
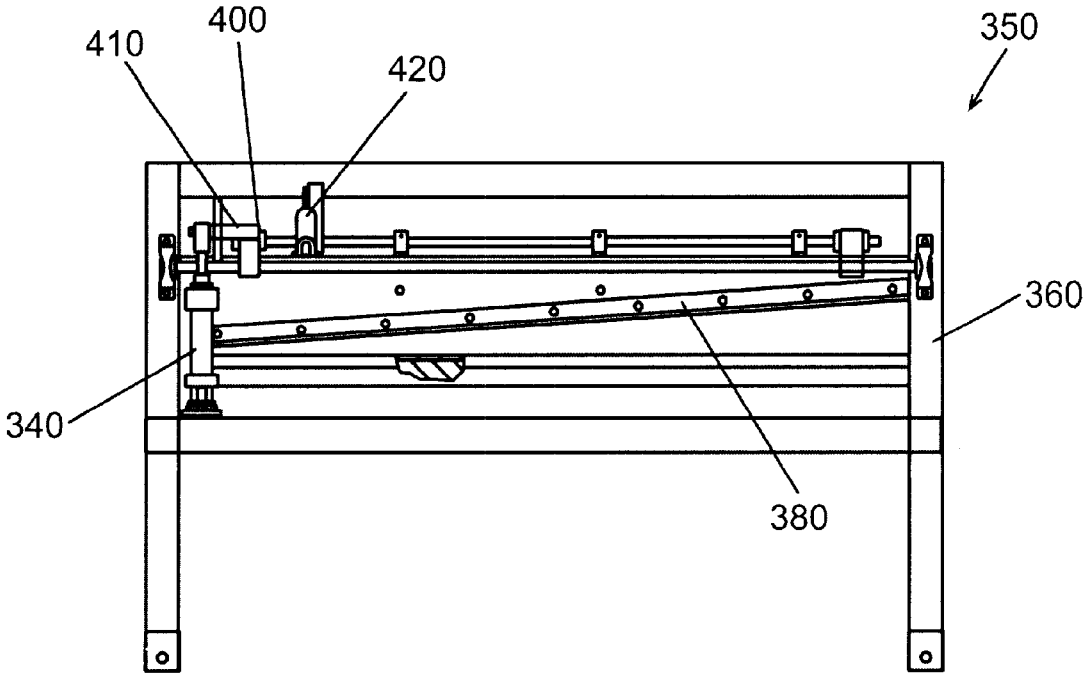
FIG. 8 is a front plan view of the cutter assembly used in the manufacturing apparatus of FIG. 5.
Figure 9:
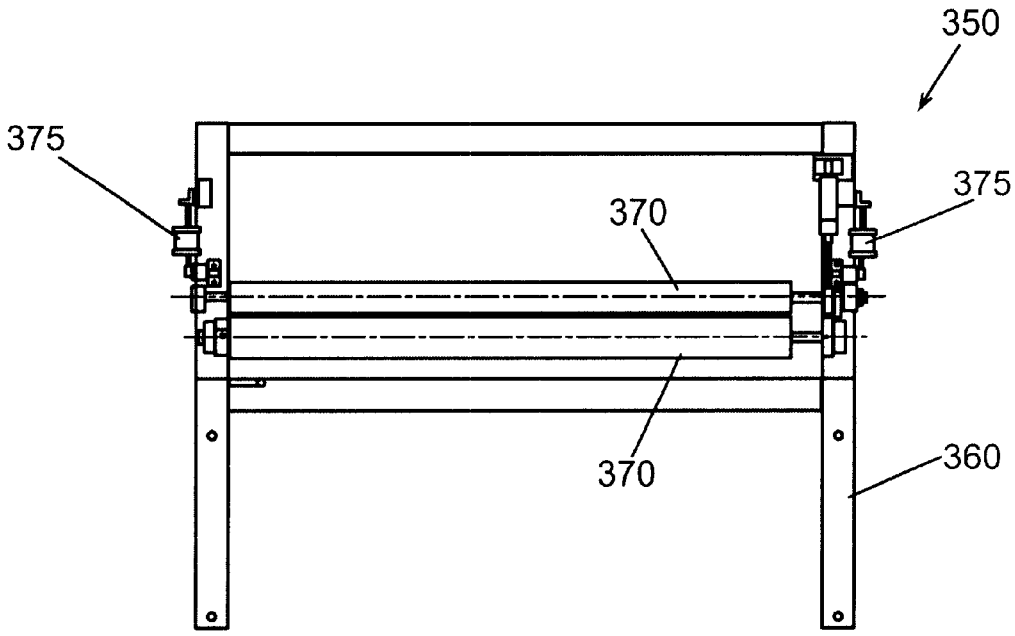
FIG. 9 is a back plan view of the cutter assembly of FIG. 8.
Figure 11:
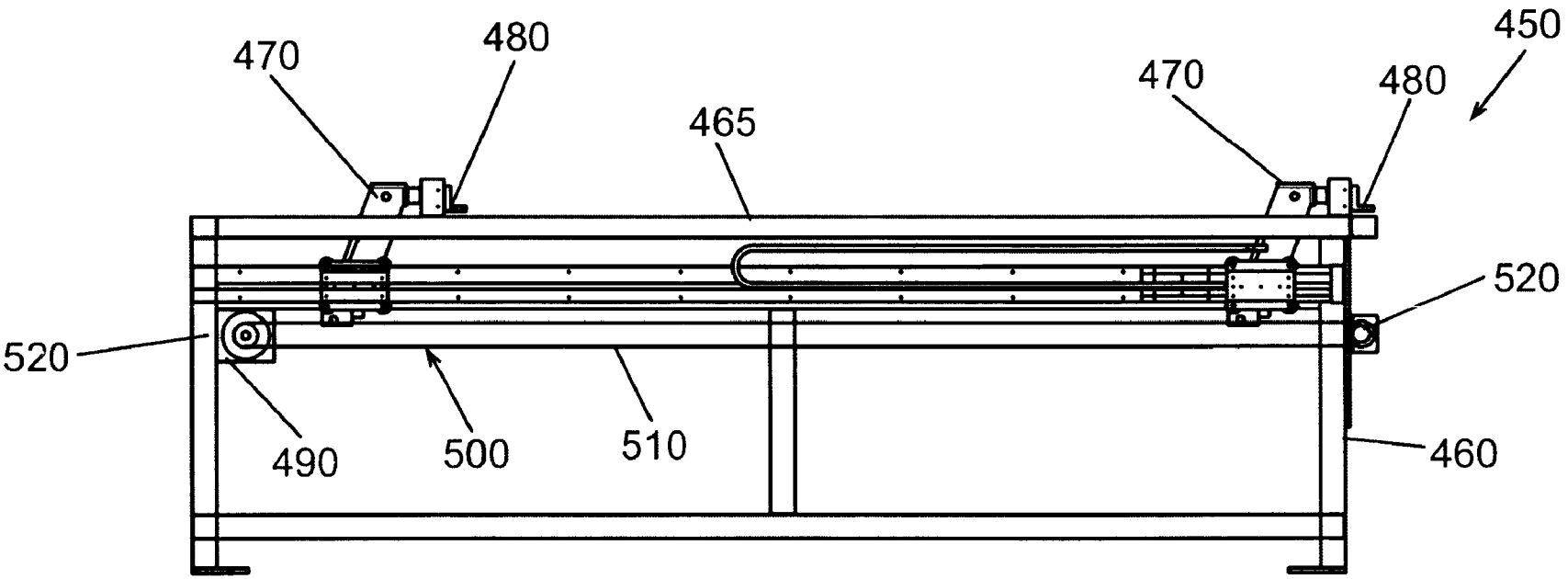
FIG. 11 is a side plan view of the hemmer assembly used in the manufacturing apparatus of FIG. 5.
Figure 11:
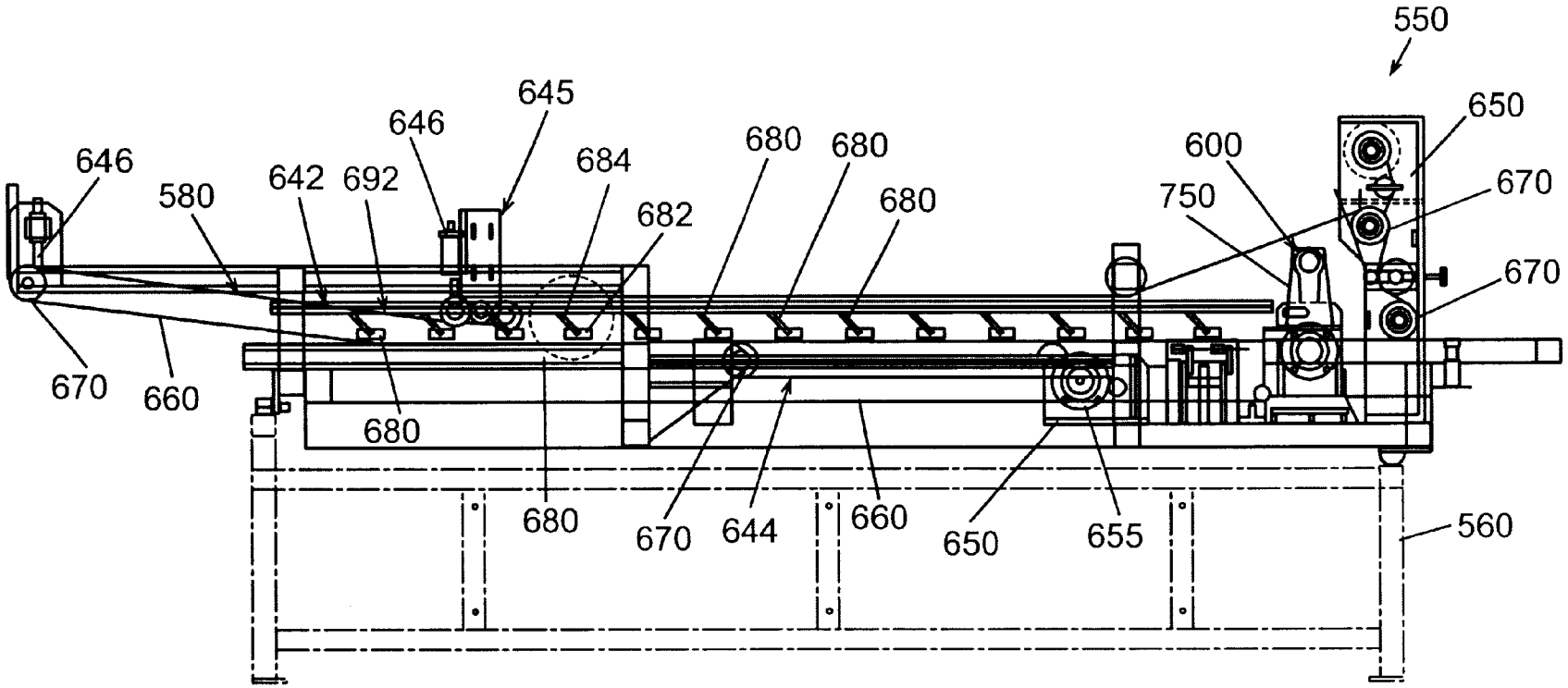

The single piece of material 20 may be formed from a continuous sheet 110 of the material. As is shown in FIG. 4, the continuous sheet 110 may be positioned on a continuous roll 115. As is shown in FIGS. 5–7, one or more of the continuous rolls 115 with the continuous sheet 110 thereon may be loaded within an unwind assembly 120. The unwind assembly 120 may be positioned along the predetermined path P. The continuous rolls 115 with the sheet of material 110 thereon may be positioned within the unwind assembly 120 upon a series of cradle rollers 130. The rollers 130 may be free rolling so as to move with the continuous roll 115 as the sheet of material 110 is fed into the apparatus 100. The rollers 130 may be covered with rubber, cotton belting, or similar types of materials. The rollers 130 may be positioned to rotate within an unwind assembly frame 140. The assembly frame 140 may be made out of steel, aluminum, or other types of rigid materials.

The unwind assembly 120 may further include a payoff module 150. The payoff module 150 may be positioned on the assembly frame 140 adjacent to the rollers 130. The payoff module 150 may include a pair of guide rollers 160. The rollers 160 may be covered with rubber, cotton belting, or similar types of materials. A motor 170 may drive the guide rollers 160 via a pulley system 175. The motor 170 may be a conventional one-half horsepower AC motor or a similar type of drive means. The pulley system 175 may include a pulley belt 180 connected to the rollers 160 and to a conventional gear reducer 185. The guide rollers 160 may drive the continuous sheet of material 110 off of the roll 115.

The payoff module 150 also may include a feeder device 190 with a dance wheel 200 and a brush 205 positioned above a feeder plate 210. The brush 205 of the feed assembly 190 removes any foreign material from the continuous sheet of material 110 and may assists in removing wrinkles. The feeder device 190 also may provide edge guiding, straightening, and pattern repeat detection.

The unwind assembly 120 may further include a unwind nip roll assembly 220. The unwind nip roll assembly 220 may be positioned adjacent to the payoff module 150 on the assembly frame 140. The unwind nip roll assembly 220 may include a pair of rollers 230. The rollers 230 may be covered with rubber, cotton belt, or similar types of materials. A motor 240 and a pulley assembly 250 may drive one or both of the rollers 230. The rollers 230 pull the continuous sheet of material 110 off of the continuous rolls 115 and out of the payoff module 150. The motor 240 may be a conventional one-half horsepower AC motor or a similar type of drive means. The pulley assembly 250 may include a pulley belt 245 connected to the rollers 230 and to a conventional gear reducer 255.

Positioned adjacent to the rollers 230 may be a number of fixed arms 260. The fixed arms 260 may have a number of fixed arm rollers 270 positioned thereon. Positioned underneath the fixed arms 260 may be a number of dancer arms 280. The dancer arms 280 also may include a pair of dancer arm rollers 290. The dancer arms 280 may be maneuverable via a hydraulic or pneumatic cylinder 300. The dancer arms 280 may maneuver up and down so as to pull a predetermined amount of material 110 through the unwind assembly 120 as a whole.

In connection with the payoff module 150 and the unwind nip roll assembly 220, the unwind assembly 120 pulls a predetermined length of the continuous sheet of material 110 off of the roll 115 under continuous tension. The predetermined length of the continuous sheet of material 120 should be enough material 110 to form the valance 10. Specifically, the unwind assembly 120 may pull about two (2) to sixteen (16) meters of the continuous sheet of material 110 per minute when in operation.

The unwind assembly 120 also may contain one or more sensors 310. The sensors 210 may be conventional photoelectric eyes, or similar types of optical, electrical, or mechanical detection devices. The sensors 310 may determine when the continuous sheet of material 110 is depleted or if the material 110 is off course as it advances through the unwind assembly 120. Proper positioning of the continuous sheet 110 within the unwind assembly 120 is useful in manufacturing the high quality valance 10.

Positioned adjacent to the unwind assembly 120 along the predetermined path P may be a cutter assembly 350. The cutter assembly 350 may include a frame 360. The frame 360 may be made out of steel, aluminum, or other types of rigid materials. The cutter assembly 350 may have a pair of rollers 370 positioned on the frame 360. The rollers 370 may engage the continuous sheet of material 110 as it emerges from the unwind assembly 120. The rollers 370 may be driven by an air cylinder 375 or a similar device so as to index a preset amount of the material 110.

Positioned on the frame 360 also may be one or more cutting blades 380. The cutting blades 380 may be a shear blade or other type of conventional blade. The cutting blades 380 may be made out of harden-able tool steel, carbide inlaid steel, or similar types of materials. The cutting blades 380 may extend along the width of the predetermined path P. One or more pneumatic cylinders 390 may operate the cutting blades 380. The pneumatic cylinder 390 may maneuver the cutting blades 380 up and down via a pivot arm system 400. An upper blade 380 and a lower blade 380 may be used. The pivot arm system 400 may include a steel arm 410 and an air cylinder 420 to provide shearing pressure to the blade 380.

The cutting blades 380 and the cutter assembly 350 as a whole may be timed so as to operate at a given interval and/or in coordination with the other components of the valance manufacturing apparatus 100 as described in more detail below. Operation of the cutter assembly 350 is controlled by the control system 105. Alternatively, the cutting blades 380 and the cutter assembly 350 may be operated via one or more sensors or other types of detection devices positioned along the predetermined path P so as to measure and cut a predetermined length of the continuous sheet of material 110.

Positioned adjacent to the cutter assembly 350 along the predetermined path P may be a feed transfer assembly 450. The feed transfer assembly 450 may include a frame 460 with a tabletop 465 thereon. The frame 460 may be made out of steel, aluminum, or other types of rigid materials. Positioned on the frame 460 may be a feed pull gripper 470. The feed pull gripper 470 may include a gripper plate 480 that descends upon the continuous sheet of material 110 as it emerges from the cutter assembly 350. The feed pull gripper 470 then advances the continuous strip of material 110 along the tabletop 465. A gripper motor 490 may drive the gripper plate 480 in the horizontal direction via a pulley assembly 500. The pulley assembly 500 may have a pulley belt 510 and a number of rollers 520. The gripper motor 490 may be an AC motor, an AC or a DC servo-motor, or a similar type of drive device. The feed pull gripper 470 pulls the continuous sheet of material 110 along the predetermined path P on the tabletop 465 for a predetermined length. The continuous sheet of material 110 is then cut by the cutter assembly 350 so as to form the piece of material 20. Operation of the feed pull gripper 470 and the feed transfer assembly 450 as a whole is controlled by the control system 105.

The predetermined path P may take a perpendicular turn as the piece of material 20 is extended onto the tabletop 465 of the feed assembly 450 to minimize the overall size of the apparatus 100. The turn may be omitted if the length of the apparatus 100 as a whole is not a concern. Additional or alternative turns may be added depending upon the available space.

Positioned along the predetermined path P and adjacent and perpendicular to the feed transfer assembly 450 may be a hemming assembly 550. The hemming assembly 550 may include a frame 560 with a tabletop 570 thereon. The frame 560 may be made out of steel, aluminum, or other types of rigid materials. The tabletop 570 may have a width in the direction perpendicular to the predetermined path P that is less than the width of the piece of material 20 as it advances from the feed transfer assembly 450. The side ends 23, 24 of the piece of material 20 therefore may hang over the edges of the tabletop 570 by a predetermined length.

Positioned on one side of the tabletop 570 may be a right side advancement device 580, a right side folding device 590, and a right side hemming device 600. Similarly, positioned on the other side of the tabletop 570 may be a left side advancement device 610, a left side folding device 620, and a left side hemming device 630. Because the right side devices 580, 590, 600 are identical to the left side devices 610, 620, 630, only the right side devices 580, 590, 600 will be described in detail.

The right side advancement device 580 may include one or more pulley systems 640, a top pulley system 642 and a bottom pulley system 644. The top pulley system 642 may extend the length of the tabletop 570 and maneuver the piece of material 20 along the tabletop 570 through the right side folding device 590 and the right side hemming device 600. The bottom pulley system 643 may extend to about the middle of the tabletop 570 as described in more detail below. The pulley systems 640 may both include a motor 650 with a gear reducer 655, one or more belts 660, and a number of rollers 670. The belts 660 maneuver about the rollers 670 via the motors 650 in a conventional fashion. The belts 660 may be made out of neoprene, urethane, or similar materials. The motors 650 may be a standard AC motor, an AC or a DC servo-motor, or a similar type of drive device.

The top pulley system 644 also may include one or more engagement devices 645. The engagement devices 645 may include a number of air cylinders 646 and a number of rollers 647 so as to engage the belts 660 of the top pulley system 642 onto the tabletop 570 as desired or controlled by the control system 105. The top pulley system 642 also may include a number of engagement skis 680 positioned along the belt 660. The engagement skis 680 may each include a runner 682 positioned on an extension 684. The engagement skis 680 may engage the piece of material 20, the belt 660, and the tabletop 570 so as to assist in advancing the material 20 there along.

The right side and the left side advancement devices 580, 610 may work in coordination with one another to advance the material 20 along the tabletop 570 under the control of the control system 105. Specifically, the engagement devices 645 may force the belts 660 to descend upon the tabletop 570 and the piece of material 20 thereon as the piece of material 20 advances out of the feed pull assembly 450. As described above, the side edges 23, 24 of the piece of material 20 may extend beyond the belts 660 and the edges of the tabletop 570. The speed of each of the belts 660 should match so that the piece of material 20 stays straight along the predetermined path P and the proper amount of material remains on either side of the tabletop 570.

Positioned in the middle of the frame 560 and underneath the tabletop 570 may be the right side fold device 590. The right side fold device 590 may include a right side fold plate 700 positioned underneath the tabletop 570. Positioned adjacent to the right side fold plate 700 may be a number of pulley systems 710. The pulley systems 710 may include a number of pulley wheels 720 with a number of pulley belts 730 thereon. The pulley belts 730 may be made out of urethane, neoprene, or similar types of materials. A motor 740 may drive the pulley belt 730. The motor 740 may be a conventional one-half (0.5) or one (1) horsepower AC motor, an AC or a DC servo-motor, or a similar type of drive means.

Each pulley system 710 is positioned along the fold plate 700 so as to fold the first side edge 23 of the piece of material 20 down and underneath itself as the material 20 advances along the predetermined path. The side edge 23 is folded so as to form the first side hem 30. Each belt 730 bends the side edge 23 of the material 20 further until the fold is complete. As the piece of material 20 passes the pulley system 643, the piece of material 20 is tucked up onto the fold plate 700. The folded side edge 23 is then captured by the bottom pulley system 643 and held in place as the folded side edge advances underneath the fold plate 700. The fold plate 700 ends and the folded side edge 23 is allowed to come up onto the top of the tabletop 570. The left side fold device 620 acts similarly to fold the second side edge 24.

Also positioned on the tabletop 570 is the right side hemming device 600. The hemming device 600 sews the first side edge 23 to create the first side hem 30. The right side hemming device 600 may include a sewing head 750 driven by a sewing motor 760. The hemming device 600 may be controlled by the control system 105. The sewing head 750 sews the hem 30 along a predetermined location. A Pfaff brand sewing or a similar type of sewing head may be employed. Further, more than one type of sewing head 750 may be employed to give the apparatus 100 versatility in accommodating various types of materials or speeds. For example, the sewing head 750 may be a lock stitch head with a bobbin or a chain stitch head with no bobbin. The lock stitch head generally provides a uniform stitch that will not unravel. The chain stitch head, however, may be significantly faster. The top pulley system 642 of the right side advancement device 580 advances the piece of material 20 through the hemming device 600. The left side hemming device 630 acts similarly to sew the second side hem 35.

Positioned adjacent to the hemming assembly 550 along the predetermined path P may be a further transfer assembly 800. The further transfer assembly 800 may include a frame 810 with a tabletop 820 thereon. The frame 810 may be made out of steel, aluminum, or other types of rigid materials. The further transfer assembly 800 also may include an in-take roller assembly 830 and an out-take roller assembly 840.

Figure 12:
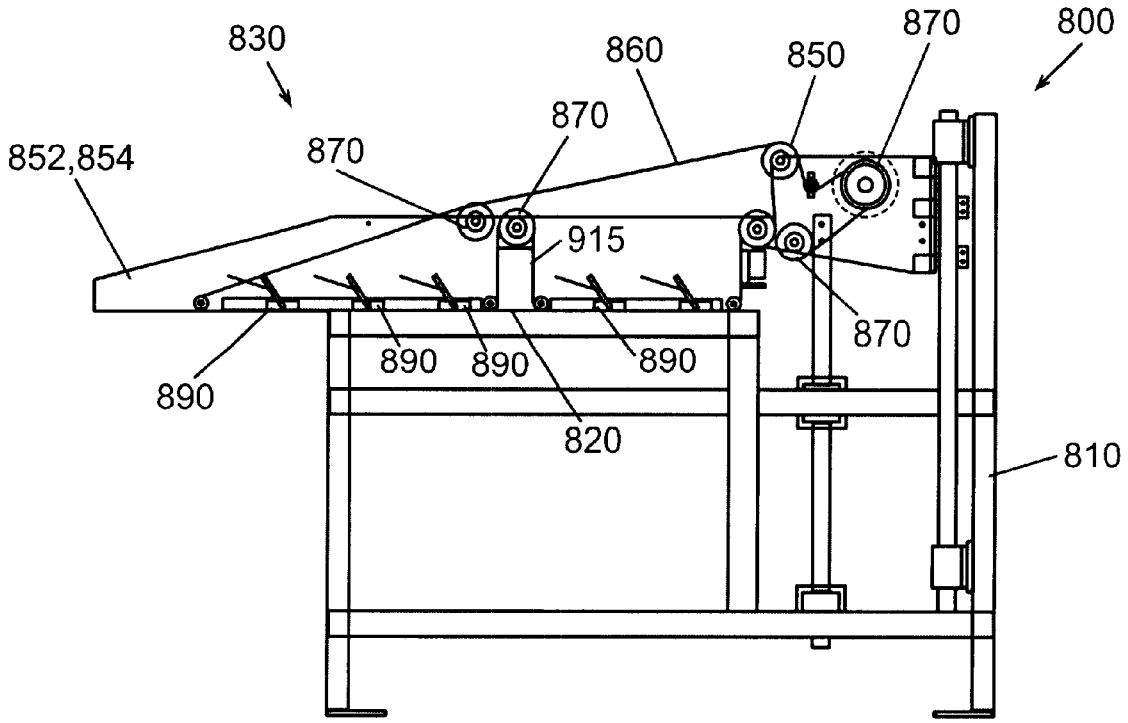
FIG. 12 is a side plan of the further transfer assembly used in the manufacturing apparatus of FIG. 5.
Figure 13:
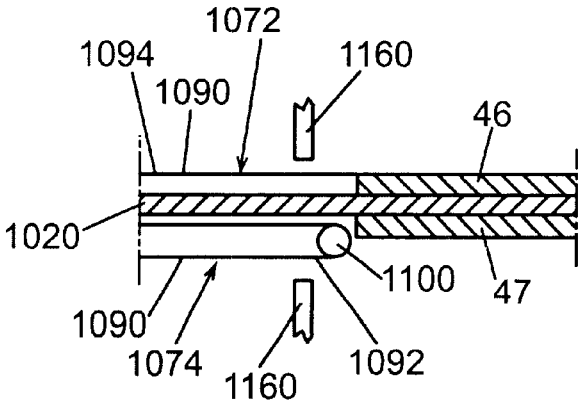
FIG. 13 is a side plan view of the detection devices used in the first fold assembly in the manufacturing apparatus of FIG. 5.

The in-take rollers assembly 830 may be positioned in-line with the hemming assembly 550 along the predetermined path P. The in-take roller assembly 830 may include a pulley system 850 with a first side 852 and a second side 854. The sides 852, 854 may be substantially identical. As is shown in FIG. 12, both sides 852, 854 may include a motor 856, one or more pulley belts 860, a number of rollers 870, and a number of engagement skis 890 positioned on a lift plate 900. The motor 856 may engage the belts 860 to drive the piece of material 20 along the tabletop 820. The motor 856 may be an AC motor, an AC or a DC servomotor, or a similar type of drive mechanism. The pulley belts 860 may be made out of urethane, neoprene, or similar materials. The engagement skis 890 may be similar to the engagement skis 680 described above.

The lift plate 900 connects both of the sides 852, 854 and extends over the tabletop 820 in the direction perpendicular to the incoming predetermined path P. The lift plate 900 may have one or more apertures 915 therein so as to accommodate the out-take roller assembly 840 as described in more detail below. The lift plate 900 may be maneuverable in the vertical direction via an air cylinder 910 mounted on the frame 810. The air cylinder 910 may be a pneumatic cylinder driven by a directional valve, a solenoid valve, or by similar means. The intake pulley system 850 thus may engage and disengage from the piece of material 20 on the tabletop 820 as directed by the control system 105.

Positioned along the tabletop 820 at a substantially perpendicular direction to the in-take roller assembly 830 is the out-take roller assembly 840. The positioning of the out-take roller assembly also turns the predetermined path P in a substantially perpendicular direction so as to minimize the overall size of the apparatus 100. As described above, the turn may be omitted if the length of the apparatus 100 as a whole is not a concern. Alternatively, additional turns may be added depending upon the available space.

The out-take roller assembly 840 may include an out-take pulley system 920. The out-take pulley system 920 may be substantially identical to the in-take pulley system 850 described above and in FIG. 12. Specifically, the out-take pulley system 920 may have a lift plate 960 operated by an air cylinder 970 mounted on the frame 810. The out-take pulley system 920 also may have a first side 975 and a second side 980 attached to the lift plate 960. The sides 975, 980 may have the same components described above, namely the motor 856, the one or more pulley belts 860, the number of rollers 870, and the number of engagement skis 890 positioned on the lift plate 960. The out-take pulley system 840 also may engage and disengage from the piece of material 20 and the tabletop 820 by maneuvering the lift plate 960 as directed by the control system 105.

The in-take roller assembly 830 and the out-take roller assembly 840 thus cooperate to advance the piece of material 20 out of the hemming assembly 550 and then in the perpendicular direction along the predetermined path P on to the components of the manufacturing apparatus 100 as described in more detail below. Specifically, the intake roller assembly 830 descends upon the piece of material 20 as it emerges from the hemming assembly 550 and positions the piece of material 20 on the tabletop 820. The tabletop 820, however, may not support the entire piece of material 20. Rather, the first end 21 may be forced over the edge of the tabletop 820 to a predetermined length. Further, a sensor 975 may be positioned along the frame 810 so as to ensure that the first end 21 is advanced to the predetermined length. The sensor 975 may be a conventional photoelectric eye or similar types of optical, electrical, or mechanical detection devices. The intake roller assembly 830 then rises via the lift plate 900. The out-take roller assembly 840 then descends through the aperture 915 in the in-take lift plate 900. The out-take roller assembly 840 then engages the piece of material 20 and advances it along the predetermined path P.

Positioned adjacent to the further transfer assembly 800 along the predetermined path P may be a first fold assembly 1000. The first fold assembly 1000 may include a frame 1010 with a tabletop 1020 thereon. The frame 1010 may be made out of steel, aluminum, or other types of rigid materials. The tabletop 1020 may have a top surface 1030 and a bottom surface 1040. The tabletop 1020 and the top surface 1030 may include a first left fold plate 1050 and a first right fold plate 1060. The first right fold plate 1060 narrows as the predetermined path P extends along the tabletop 1020 such that the second end 22 of the piece of material 20 falls off of the tabletop 1020 to a predetermined length.

The tabletop 1020 also may have a number of pulley systems 1070, a top pulley system 1072 and a bottom pulley system 1074. The pulley systems 1070 may each have a motor 1080. The motor 1080 may be a conventional AC or a DC servomotor. The pulley systems 1070 also may each have one or more belts 1090, a lower belt 1092 and an upper belt 1094, and one or more rollers 1100. The belts 1090 may be made out of urethane, neoprene, or similar types of materials. The top pulley system 1072 may advance the piece of material 20 along the length of the tabletop 1020. The bottom pulley system 1074 may be positioned below the tabletop 1020 so as to advance the second end 22 of the piece of material 20 as described in more detail below. The lower pulley system 1074 also may include a series of skis 1110 positioned adjacent to the lower belt 1092. The skis 1110 may be identical to the skis 680 described above.

A folding system 1120 may be positioned along the first right fold plate 1060 of the tabletop 1020. The fold system 1120 may have a number of pulleys 1130 with a number of pulley belts 1140 thereon. A conventional motor such as an AC motor may drive the folding system 1120. Similar types of drive means also may be used. Each belt 1140 folds the second end 22 of the material 20 onto the bottom surface 1040 of the tabletop 1020. The material 20 is then captured by the bottom pulley system 1074 and held against the bottom surface 1040 of the frame 1010 by the lower belt 1092 and the skis 1110. The first right fold plate 1060 may end about at the end of the fold system 1120 as the predetermined path P continues. The piece of material 20 may then be captured between the belts 1092, 1094 of the top and bottom pulley systems 1072, 1074.

One or more sensors 1160 may be positioned along the tabletop 1020 on both the top surface 1030 and the bottom surface 1040. The sensors 1160 may determine whether the top side 46 of the piece of material 20 is even with the bottom side 47. In other words, the sensors 1160 may determine if the fold of the second end 22 of the piece of material 20 was made evenly. If not, the control system 105 may inform one of the servo-motors 1080 to either speed up or slow down by a predetermined amount so as to bring the respective edges in line.

For example, if the bottom side 47 is slightly behind the top side 46, the control system 105 may speed up the servo-motor 1080 of the bottom pulley system 1074 by a predetermined number of counts and/or for a predetermined amount of time. The control system 105 may have a look up table with a predetermined number of counts corresponding to a predetermined difference in distance. The number of counts and/or the amount of time may be predetermined based upon the difference in distance. If, for example, the bottom servo-motor 1080 is operating at 25,000 counts and the sensors 1160 determine that the bottom side 47 is behind the top side 46 by three (3) millimeters, the control system 105 may speed the servo motor 1080 by about 150 counts for about 0.4 seconds. This advance should be sufficient to equalize the respective position of the sides 46, 47. Similar types of adjustment techniques may be used to ensure a proper fold.

Positioned adjacent to the first fold assembly 1000 along the predetermined path P may be a second fold assembly 1200. The second fold assembly 1200 may include a frame 1210 with a tabletop 1220 thereon. The frame 1210 may be made out of steel, aluminum, or other types of rigid materials. The top pulley system 1072 continues along the tabletop 1220 of the second fold assembly 1200 or a separate system may be used. The second fold assembly 1200 also may include a number of pulley systems 1230. The pulley systems 1230 may include a top system 1231 and a bottom system 1232. These pulley systems 1231, 1232 may be driven by a top motor 1240 and a bottom motor 1245. The motors 1240, 1245 may be conventional AC motors, AC or DC servo-motors, or similar types of drive means, and may be identical to motor 1080. The pulley systems 1230 also include one or more pulley belts 1250 and rollers 1260. The pulley systems 1072, 1230 advance the piece of material 20 on top and underneath the tabletop 1220 via the belts 1250. The belts 1250 may be made out of urethane, neoprene, or similar types of materials.

The second fold assembly 1200 also may include a number of skis 1270 so as to force at least the belt 1250 of the top system 1231 against the folded piece of material 20 and the tabletop 1220 as the material 20 emerges from the first fold assembly 1000. Positioned further along the predetermined path P and along the frame 1210 may be a tucker assembly 1290 with a tucker plate 1280. The tucker assembly 1290 may fold the first end 21 over the second end 22 such that a small amount of the second end 22 is folded within the first end 21. Specifically, the first end is folded under the tabletop 1220 by the tucker assembly 1290 and then brought to the top of the tabletop 1220 by the belts 1250 as the tucker plate 1280 ends.

Positioned adjacent to the tucker assembly 1290 may be a further pair of sensors 1160. The sensors 1160 may detect the position of the first end 21 and the second end 22 along the tabletop 1220 to ensure that the second fold is accurate. The control system 105 likewise may alter the speed of the belts 1250 as needed and as is described above.

Also positioned adjacent to the tucker assembly 1290, may be a pair of sewing heads 1300, a first sewing head 1310 and a second sewing head 1320. Alternatively, the sewing heads 1300 may be positioned on opposite sides of the tabletop 1220 or a single sewing head 1320 with two needles could be used. Both sewing heads 1300 may have a sewing motor 1330. The sewing heads 1300 may be similar to the sewing heads 750 described above. The sewing heads 750 may sew the first hem line 65 and the second hem line 70 so as to create the valance 10 with the top pocket 50, the hanger pocket 55, and the bottom pocket 60. The sewing heads 1300 may be positioned at any place along the tabletop 1220. For example, the first hem line 65 may be sewn by the first sewing head 1310 before the tucker assembly 1290 completes the fold of the first end 21. The valance 10 may then continue along the predetermined path P where it may be removed from the apparatus 100.

In use, the continuous sheet 110 of the material is loaded on the continuous roll 115. The sheet of material 110 is pulled off of the roll 115 via the unwind nip roll assembly 220 in the unwind assembly 120. A predetermined length of the sheet of material 110 is fed through the cutter assembly 350 by the feed pull gripper 470 of the feed transfer assembly 450. After the sheet of material 110 has been stretched out on the feed transfer assembly 450, the blade 370 of the cutter assembly 350 cuts the piece of material 20 from the continuous sheet of material 110. The piece of material 20 is then fed into the hemming assembly 550 where the side ends 23, 24 of the material 20 are folded over by the folding devices 590, 620 and hemmed in the hemming devices 600, 630.

The piece of material 20 is then transferred into the further transfer assembly 800 where a predetermined length of the first end 21 of the piece of material 20 hangs over the tabletop 820 of the transfer assembly 800. The piece of material 20 then makes a perpendicular turn into the first fold assembly 1000 where the second end 22 of the piece of material 20 is folded up underneath the front side 46 and then held into place. The advance of the piece of material 20 may be monitored by the sensors 1160 to ensure an accurate fold. The piece of material 20 then continues into the second fold assembly 1200 where the folded second end 22 of the piece of material 20 moves on to the tabletop 1220 while the first end 21 is folded underneath. The piece of material 20 is then fed through two (2) sewing heads 1300 so as to complete the valance 10.

It should be apparent that the foregoing description relates only to the preferred embodiments of the present invention and that numerous changes and modifications made be made herein without departing from the spirit and scope of the invention as defined by the following claims.

What is claimed is:

1. An apparatus for manufacturing a valance with a plurality of transverse pockets from a continuous strip of material, comprising:

a feed pull assembly positioned along a predetermined path for pulling a predetermined length of said continuous strip of material onto a tabletop;

a cutter assembly positioned along said predetermined path for cutting said predetermined length of said material from said continuous strip of material;

a first fold assembly positioned along said predetermined path so as fold a first end of said predetermined length of said material;

a second fold assembly positioned along said predetermined path so as to fold a second end of said predetermined length of said material under said first end of said predetermined length of said material; and a hemming assembly positioned along said predetermined path so as to sew said plurality of transverse pockets.

2. The apparatus of claim 1, further comprising a programmable logic controller to control said feed pull assembly, said cutter assembly, said first fold assembly, said second fold assembly, and said hemming assembly.

3. The apparatus of claim 1, further comprising a unwind assembly positioned along said predetermined path.

4. The apparatus of claim 3, wherein said unwind assembly comprises a plurality of rollers so as to support said continuous strip of material on a roll.

5. The apparatus of claim 3, wherein said unwind assembly comprises a dancer assembly to pull said predetermined length of said strip of material off of said roll.

6. The apparatus of claim 5, wherein said dancer assembly comprises a stationary roller and a dancer roller such that said dancer roller pulls said predetermined length of said strip of material over said stationary roller.

7. The apparatus of claim 1, wherein said cutter assembly comprises a blade operated by a pneumatic cylinder.

8. The apparatus of claim 1, wherein said feed pull assembly comprises a feed pull gripper operated by a motor.

9. The apparatus of claim 1, further comprising a side hem apparatus positioned adjacent to said feed pull assembly along said predetermined path.

10. The apparatus of claim 9, wherein said side hem apparatus comprises a tabletop, said tabletop comprising a dimension of lesser amount than a dimension of said predetermined length of said material, such that a first side and a second side of said predetermined length of said material fall over said tabletop.

11. The apparatus of claim 10, wherein said side hem apparatus comprises an advancement device so as to advance said predetermined length of said material along said tabletop.

12. The apparatus of claim 11, wherein said advancement device comprises an advancement belt driven by a motor.

13. The apparatus of claim 12, wherein said advancement device comprises a first advancement device positioned on a first side of said tabletop and a second advancement device positioned on a second side of said tabletop.

14. The apparatus of claim 10, wherein said side hem apparatus comprises a side fold apparatus so as to fold said first side and said second side of said predetermined length of said material.

15. The apparatus of claim 14, wherein said side fold apparatus comprises a pulley system so as to fold said first side and said second side of said predetermined length of said material under said tabletop.

16. The apparatus of claim 15, wherein said side fold apparatus comprises a first side fold apparatus positioned on a first side of said tabletop to fold said first side of said predetermined length of said material and a second side fold apparatus positioned on a second side of said tabletop to fold said second side of said predetermined length of said material.

17. The apparatus of claim 9, wherein said side hem apparatus comprises a first side hemming device and a second side hemming device so as to hem said predetermined length of said material along said first side and said second side.

18. The apparatus of claim 1, further comprising a transfer assembly positioned along said predetermined path so as maneuver said predetermined length of said material in a perpendicular fashion.

19. The apparatus of claim 18, wherein said transfer assembly comprises an in-take roller assembly extending in a first direction and an out-take roller assembly extending in a second direction.

20. The apparatus of claim 19, wherein said in-take and said out-take roller assemblies each comprise a drive belt driven by a motor.

21. The apparatus of claim 20, wherein said in-take and said out-take roller assemblies each comprise a lift plate so as to provide motion in the vertical direction such that when said in-take roller assembly is engaged on said predetermined length of said material said out-take roller assembly is raised and when said out-take roller assembly is engaged on said predetermined length of said material said in-take roller assembly is raised.

22. The apparatus of claim 1, wherein said first fold assembly comprises a tabletop, said tabletop comprising a dimension of lesser amount than a dimension of said predetermined length of said material, such that a first end of said predetermined length of said material falls over said tabletop.

23. The apparatus of claim 22, wherein said tabletop comprises a first side fold plate.

24. The apparatus of claim 23, wherein said first fold assembly comprises a first side advancement system and a second side advancement system positioned along said tabletop.

25. The apparatus of claim 24, wherein said first side and said second side advancement system each comprise a drive belt and a motor such that said motor drives said drive belt and said predetermined length of said material at a predetermined speed.

26. The apparatus of claim 25, wherein said motor comprises a servo-motor.

27. The apparatus of claim 25, wherein said first fold assembly comprises a fold system position adjacent to said first side fold plate such that said fold system folds said first end of said predetermined length of said material under said fold plate until a first fold is formed.

28. The apparatus of claim 27, wherein said fold system comprises a plurality of drive belts driven by a motor such that each of said plurality of drive belts folds the first end of said predetermined length of said material underneath said first fold plate.

29. The apparatus of claim 27, wherein said first fold plate ends along said predetermined path about where said second side advancement system begins, such that said first end of said predetermined length of said material may be advanced between said first side advancement system and said second side advancement system.

30. The apparatus of claim 27, wherein said first fold assembly comprises a first sensor positioned over said tabletop, a second sensor positioned under said tabletop, and a control system operative with said first sensor, said second sensor, and said motor of said second side drive system.

31. The apparatus of claim 30, wherein said first sensor and said second sensor detect if said first fold is even along said predetermined path such that said control system may alter said predetermined speed of said motor by a predetermined amount.

32. The apparatus of claim 1, wherein said second fold assembly comprises a tabletop, said tabletop comprising a dimension of lesser amount than a dimension of said predetermined length of said material, such that a second end of said predetermined length of said material fall over said tabletop.

33. The apparatus of claim 32, wherein said second fold assembly comprises a first side advancement system and a second side advancement system positioned along said tabletop.

34. The apparatus of claim 32, wherein said first side and said second side advancement systems each comprise a drive belt and a motor such that said motor drives said drive belt and said predetermined length of said material at a predetermined speed.

35. The apparatus of claim 34, wherein said motor comprises a servo-motor.

36. The apparatus of claim 32, wherein said second fold assembly comprises a tucker assembly positioned along said tabletop so as to fold said second end of said predetermined length of said material.

37. The apparatus of claim 1, wherein said hemming assembly comprises a first sewing head and a second sewing head positioned on a tabletop.

38. A method of creating a valance from a continuous strip of material in a high-speed manner, said method comprising the steps of:

pulling a predetermined length of material on to a tabletop;

cutting said predetermined length of material from said continuous strip of material;

advancing said predetermined length of material along said tabletop;

folding a first end of said predetermined length of material against itself;

folding a second end of said predetermined length of material under said first end; and hemming said predetermined length of material transversely to form a plurality of pockets therein.

39. An apparatus for manufacturing a valance with a plurality of transverse pockets from a continuous strip of material, comprising:

a feed pull assembly positioned along a predetermined path for pulling a predetermined length of said continuous strip of material onto a tabletop;

a cutter assembly positioned along said predetermined path for cutting said predetermined length of said material from said continuous strip of material;

a first fold assembly positioned along said predetermined path so as fold a first end of said predetermined length of said material via a plurality of belts;

a second fold assembly positioned along said predetermined path so as to fold a second end of said predetermined length of said material via a plurality of belts; and a hemming assembly positioned along said predetermined path so as to sew said plurality of transverse pockets.

* * * * *